US009208984B2

(12) United States Patent
Kawata et al.

(10) Patent No.: US 9,208,984 B2
(45) Date of Patent: Dec. 8, 2015

(54) MAGNETRON

(71) Applicant: Panasonic Intellectual Property Management Co., Ltd., Osaka-shi, Osaka (JP)

(72) Inventors: Kohei Kawata, Shiga (JP); Takanori Handa, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/531,071

(22) Filed: Nov. 3, 2014

(65) Prior Publication Data

US 2015/0123538 A1 May 7, 2015

(30) Foreign Application Priority Data

Nov. 7, 2013 (JP) ..... 2013-231297

(51) Int. Cl.
*H01J 25/50* (2006.01)
*H01J 23/00* (2006.01)

(52) U.S. Cl.
CPC ..... *H01J 25/50* (2013.01); *H01J 23/005* (2013.01)

(58) Field of Classification Search
CPC ..... H05J 25/587
USPC ..... 315/39.51, 39.53; 204/298.19
See application file for complete search history.

(56) References Cited

U.S. PATENT DOCUMENTS

| | | | | |
|---|---|---|---|---|
| 5,328,585 | A * | 7/1994 | Stevenson et al. | 204/298.2 |
| 6,228,236 | B1 * | 5/2001 | Rosenstein et al. | 204/298.2 |
| 2009/0039753 | A1 | 2/2009 | Handa | |

FOREIGN PATENT DOCUMENTS

| | | | |
|---|---|---|---|
| EP | 2 546 861 | A1 | 1/2013 |
| JP | 4-284334 | A | 10/1992 |
| JP | 5-54805 | A | 3/1993 |
| JP | 3169623 | B2 | 3/2001 |
| JP | 2003-100224 | A | 4/2003 |
| JP | 2006-40574 | A | 2/2006 |
| JP | 2009-43559 | A | 2/2009 |
| JP | 2011-192459 | A | 9/2011 |

OTHER PUBLICATIONS

Extended European Search Report in corresponding European Application No. 14190771.7, dated Mar. 11, 2015, 5 pages.

* cited by examiner

*Primary Examiner* — Minh D A
(74) *Attorney, Agent, or Firm* — Brinks Gilson & Lione

(57) ABSTRACT

A magnetron includes a cooling block having an annular continuous portion with opposite end portions opposed to each other, the cooling block being secured to an outer peripheral surface of the cylindrical anode body, the cooling block having a coolant circulation pathway defined therein, a tightening member engageable with the opposite end portions of the cooling block to tighten the cooling block by reducing a distance between the opposite end portions of the cooling block, and a pair of pipe joints each connected to a portion of the cooling block adjacent to one of the opposite end portions so as to communicate with the coolant circulation pathway. The tightening member is disposed between connecting portions of the pair of pipe joints with the cooling block so as to extend in a direction inclined with respect to a plane including an annular direction of the cooling block.

6 Claims, 6 Drawing Sheets

MAGNETRON

RELATED APPLICATIONS

This application claims priority under 35 U.S.C. §119 to Japanese Patent Application No. 2013-231297 filed on Nov. 7, 2013, the entire content of which is hereby incorporated by reference.

BACKGROUND OF THE INVENTION

1. Technical Field

The technical field relates generally to a magnetron for generating microwaves.

2. Description of Related Art

A conventional magnetron for generating microwaves is used for a magnetron utilization appliance as typified by, for example, a microwave oven and is known as having a variety of constructions. In order to remove heat generated by the magnetron that accompanies the generation of the microwaves, an air-cooled type method or a liquid-cooled type method is used. In the liquid-cooled type magnetron, a cooling block provided with a coolant circulation pathway is used (see, for example, Patent Document 1).

A construction of the liquid-cooled type magnetron as disclosed in Patent Document 1 is explained with reference to FIG. 9 showing a whole construction of the magnetron and FIG. 10 showing a construction of the cooling block.

As shown in FIG. 9, the magnetron 100 is provided with a yoke 106 and the cooling block 110 accommodated within the yoke 106 so as to be held in close contact with an outer peripheral surface of a cylindrical anode body (not shown) accommodated within the yoke 106. The cooling block 110 has a circulation pathway 112 defined therein to flow a liquid for cooling the cylindrical anode body.

As shown in FIG. 10, the cooling block 110 is made of a material having a cooling function and formed into a generally rectangular parallelepiped. The cooling block 110 in the form of a rectangular parallelepiped has a side surface to which an inlet pipe joint 112A and an outlet pipe joint 112B both communicating with the circulation pathway 112 are connected.

The cooling block 110 has an annular continuous portion encircling the outer peripheral surface of the cylindrical anode body and a discontinuous portion where opposite end portions of the annular continuous portion are opposed to each other. More specifically, the opposite end portions of the annular continuous portion are formed with respective flanges 114 opposed to each other, between which the annular discontinuous portion is formed. Each of the flanges 114 has two through-holes 115 defined therein. A tightening member 116 is inserted into the opposing through-holes 115 to tighten (screw-tighten) the flanges 114 by reducing the distance between the two flanges 114 to bring an inner peripheral surface of the cooling block 110 into close contact with the outer peripheral surface of the cylindrical anode body.

Patent Document 1: No. JP 2011-192459 A

SUMMARY OF THE INVENTION

The cooling block 110 of such a conventional magnetron 100 is formed into an integrated member having a desired shape by cutting a member generally in the form of a rectangular parallelepiped.

In the cooling block 110 of Patent Document 1, however, the annular continuous portion is formed with the flanges 114 at the opposite end portions to tighten the cooling block 110 and the flanges 114 are so formed as to extend considerably outwardly from connecting surfaces of the pipe joints 112A, 112B. For this reason, if the cooling block 110 is formed into a shape as disclosed in Patent Document 1 by cutting the member generally in the form of a rectangular parallelepiped, a substantial amount of material must be removed, thus posing a problem of wastefulness.

Also, after the pipe joints 112A, 112B have been connected to the cooling block 110, insertion of the tightening members 116 into the associated through-holes 115 may become difficult and access to the tightening members 116 engaged with the flanges 114 may become difficult.

One non-limiting and exemplary embodiment provides a magnetron capable of reducing waste in producing a cooling block and of improving access to pipe joints and a tightening member. Additional benefits and advantages of the disclosed embodiments will be apparent from the specification and Figures. The benefits and/or advantages may be individually provided by the various embodiments and features of the specification and drawings disclosure, and need not all be provided in order to obtain one or more of the same.

In one general aspect of the present disclosure, the techniques disclosed here feature: a magnetron comprising a cylindrical anode body; a cooling block formed into an integrated member having an annular continuous portion with opposite end portions opposed to each other, the cooling block being secured to an outer peripheral surface of the cylindrical anode body so as to encircle the cylindrical anode body, the cooling block having a coolant circulation pathway defined therein to cool the cylindrical anode body; a tightening member engageable with the opposite end portions of the cooling block to tighten the cooling block by reducing a distance between the opposite end portions of the cooling block to thereby press an inner peripheral surface of the cooling block against the outer peripheral surface of the cylindrical anode body; and a pair of pipe joints each connected to a portion of the cooling block adjacent to one of the opposite end portions so as to communicate with the coolant circulation pathway, wherein the tightening member is disposed between connecting portions of the pair of pipe joints with the cooling block so as to extend in a direction inclined with respect to a plane including an annular direction of the cooling block.

The present disclosure can provide a magnetron capable of reducing waste in producing the cooling block and of improving access to the pipe joints and the tightening member.

DETAILED DESCRIPTION OF THE PREFERRED EMBODIMENTS

Figure 1:
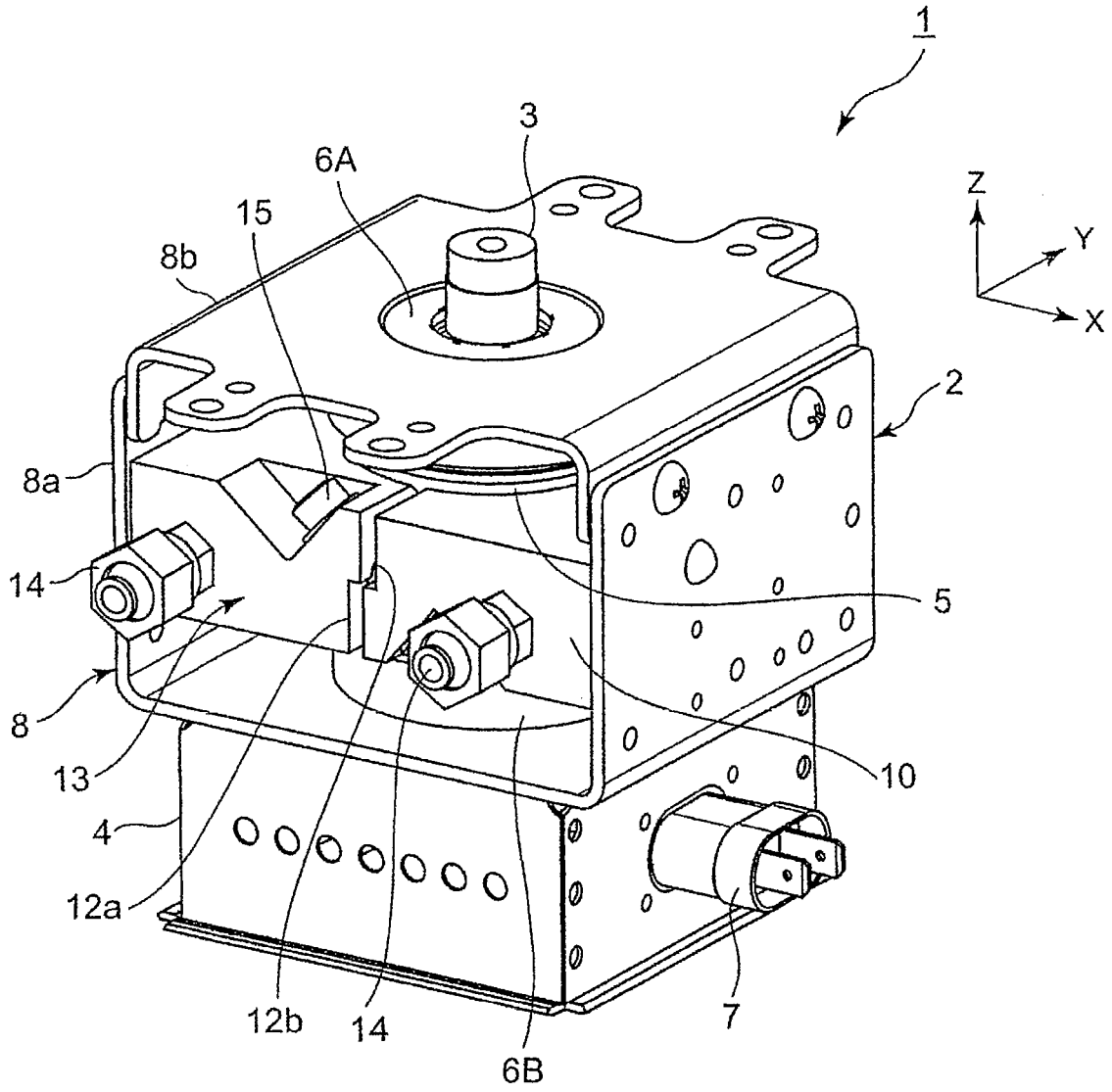
FIG. 1 is a view (perspective view) showing a general structure of a magnetron according to a first embodiment of the present disclosure.

A magnetron of a first aspect of the present disclosure comprises a cylindrical anode body; a cooling block formed into an integrated member having an annular continuous portion with opposite end portions opposed to each other, the cooling block being secured to an outer peripheral surface of the cylindrical anode body so as to encircle the cylindrical anode body, the cooling block having a coolant circulation pathway defined therein to cool the cylindrical anode body; a tightening member engageable with the opposite end portions of the cooling block to tighten the cooling block by reducing a distance between the opposite end portions of the cooling block to thereby press an inner peripheral surface of the cooling block against the outer peripheral surface of the cylindrical anode body; and a pair of pipe joints each connected to a portion of the cooling block adjacent to one of the opposite end portions so as to communicate with the coolant circulation pathway, wherein the tightening member is disposed between connecting portions of the pair of pipe joints with the cooling block so as to extend in a direction inclined with respect to a plane including an annular direction of the cooling block.

In this construction, because the tightening member extends in the direction inclined with respect to the plane including the annular direction of the cooling block, while employing an arrangement in which the tightening member is disposed between the connecting portions of the pair of pipe joints, access to the tightening member is less likely to be affected by the presence of the pipe joints. Accordingly, access to the pipe joints and the tightening member can be improved. Further, when one of the tightening member and the pipe joints is accessed, interference with the others can be avoided, thus making it possible to enhance the degree of freedom in arranging a connecting surface of the cooling block to which the pipe joints are connected. Accordingly, an arrangement of the pipe joints and the tightening member capable of reducing a material to be removed during cutting of the cooling block can be realized.

In the magnetron according to the first aspect, the second aspect of the present disclosure is characterized in that the opposite end portions of the annular continuous portion of the cooling block have respective insertion holes defined therein into which the tightening member is inserted, a connecting surface of the cooling block with the pair of pipe joints being positioned at a location overlapping with or outwardly of a location of formation of the insertion holes. This construction can reduce the amount of a member (material) generally in the form of a rectangular parallelepiped to be removed in order to form the connecting surface of the cooling block with the pipe joints, thus making it possible to reduce waste in producing the cooling block.

In the magnetron according to the first or second aspect, the third aspect of the present disclosure is characterized in that the cooling block has a regulatory structure configured to regulate a movement of the opposite end portions of the cooling block in a direction perpendicular to the plane including the annular direction of the cooling block when the opposite end portions of the cooling block are engaged with each other in tightening the cooling block by the tightening member. By this construction, while employing an arrangement in which the tightening member extends in the direction inclined with respect to the plane including the annular direction of the cooling block, the regulatory structure can regulate the movement of the opposite end portions of the cooling block in the direction perpendicular to the plane including the annular portion, thus making it possible to realize positive tightening by the tightening member.

In the magnetron according to anyone of the first to third aspects, the fourth aspect of the present disclosure is characterized in that an angle of inclination of the tightening member is less than 45 degrees with respect to the plane including the annular direction of the cooling block. By this construction, a force generated by tightening the tightening member can have a component in a direction along the plane including the annular portion that is greater than a component in the direction perpendicular to such a plane, thus making it possible to realize positive tightening by the tightening member.

In the magnetron according to anyone of the first to fourth aspects, the fifth aspect of the present disclosure is characterized in that the cooling block has two recesses defined in a connecting surface thereof with the pair of pipe joints and opposite end portions of the tightening member are respectively accommodated within the two recesses. In this construction, because the opposite end portions of the tightening member are accommodated within respective recesses, when one of the tightening member and the pipe joints is accessed, interference with the others can be curbed.

In the magnetron according to anyone of the first to fifth aspects, the sixth aspect of the present disclosure is characterized in that the cooling block has a generally square outer periphery, on one end of which the pair of pipe joints and the tightening member are disposed. This construction can reduce waste when the member in the form of a generally rectangular parallelepiped is cut and improve access to the pipe joints and the tightening member while employing an arrangement in which the pair of pipe joints and the tightening member are collectively disposed on one end of the square outer periphery of the cooling block.

EMBODIMENTS

Embodiments of the present disclosure are hereinafter described in detail with reference to the drawings.

Figure 2:
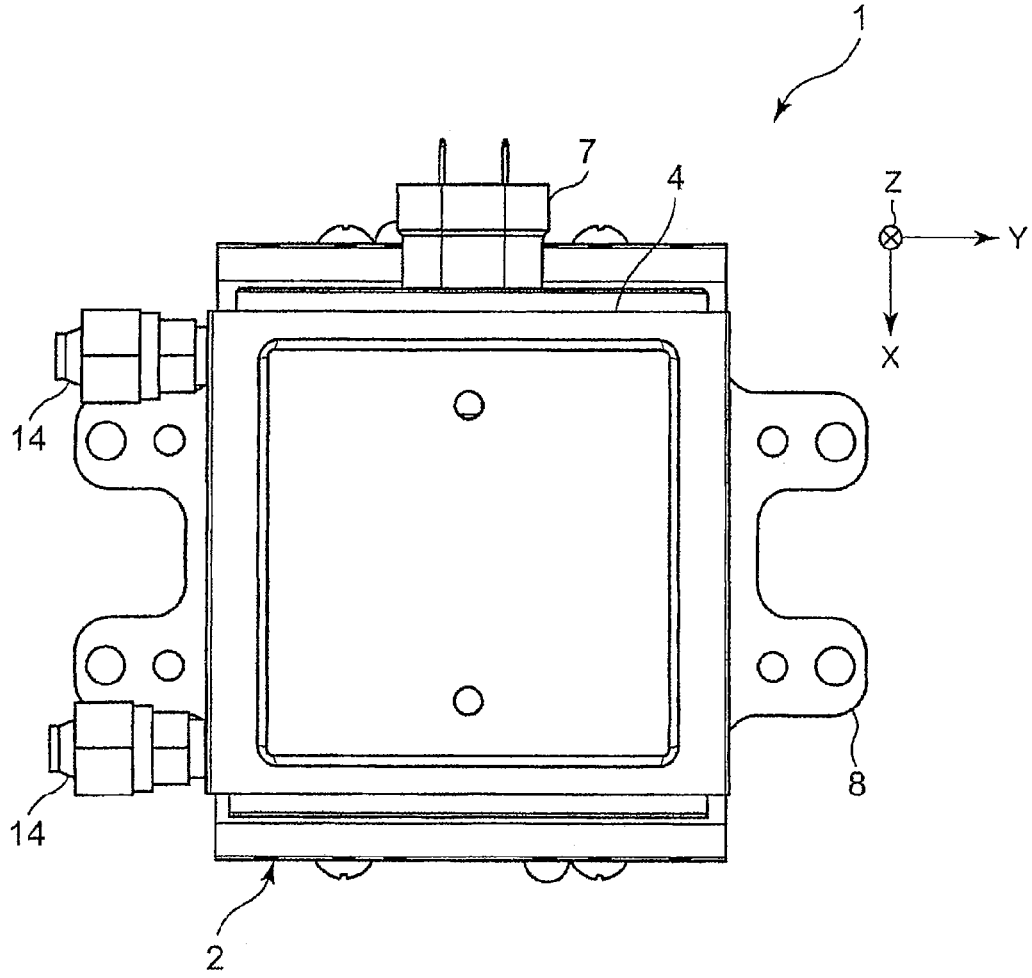
FIG. 2 is a bottom plan view of the magnetron according to the first embodiment.

FIG. 1 is a view showing a general structure of a magnetron 1 according to a first embodiment of the present disclosure and FIG. 2 is a bottom plan view of the magnetron 1. As shown in FIG. 1 and FIG. 2, the magnetron 1 is provided with a magnetic yoke 2, an output portion 3 mounted on an upper portion of the magnetic yoke 2, and a filter 4 mounted on a lower portion of the magnetic yoke 2. The magnetic yoke 2 accommodates therein a cylindrical anode body 5, two annular permanent magnets 6A, 6B mounted respectively on upper and lower ends of the cylindrical anode body 5, and a cooling block 10 disposed so as to encircle the cylindrical anode body 5. The filter 4 is provided with a choke coil (not shown) and a lead-through capacitor 7. In FIG. 1, a vertical direction (an axial direction of the cylindrical anode body 5) is defined as a Z direction and two directions perpendicular to the Z direction and running at right angles to each other are defined as an X direction and a Y direction, respectively. Also, in the magnetron 1 according to the first embodiment, the axial direction of the cylindrical anode body 5 lies in the Z direction (vertical direction), but the axial direction of the cylindrical anode body 5 may lie in a right-left direction or a front-back direction.

The magnetic yoke 2 is provided with a casing 8 having a main body 8*a* and a lid 8*b*. The main body 8*a* has a pair of opposing open side surfaces and an open upper surface, and the lid 8*b* closes the open upper surface of the main body 8*a*. The annular permanent magnets 6A, 6B, the cylindrical anode body 5 and the cooling block 10 are accommodated within the casing 8 of the magnetic yoke 2.

The cylindrical anode body 5 is fixed by the casing 8 of the magnetic yoke 2 in such a manner that the cylindrical anode body 5 and the annular permanent magnets 6A, 6B disposed on the opposite ends thereof are sandwiched together by the casing 8 of the magnetic yoke 2. In FIG. 1, the annular permanent magnet 6B disposed on the lower side is an input side magnet and the annular permanent magnet 6A disposed on the upper side is an output side magnet. A plurality of anode vanes (not shown) are disposed radially within the cylindrical anode body 5 and a cavity resonator is formed by a space encircled by adjacent anode vanes and the cylindrical anode body 5. A cathode body (not shown) is disposed at a central portion of the cylindrical anode body 5 and a space encircled by the cathode body and the anode vanes is an active space.

When the magnetron 1 according to the first embodiment is used, after the inside of the magnetron 1 has been evacuated, thermal electrons are emitted by applying a desired voltage to the cathode body so as to apply a direct-current high voltage in between the anode vanes and the cathode body. In the active space, a magnetic field is formed by the annular permanent magnets 6A, 6B in a direction perpendicular to a direction in which the cathode body and the cylindrical anode body 5 are opposed to each other. Electrons emitted from the cathode body are drawn towards the anode vanes by applying the direct-current high voltage in between the anode vanes and the cathode body. An electric field and the magnetic field in the active space cause the electrons to undergo an orbiting movement while undergoing a rotating movement before they reach the anode vanes. Energy caused by the electron movements at this moment is given to the cavity resonator, which in turn generates microwaves.

Figure 3:
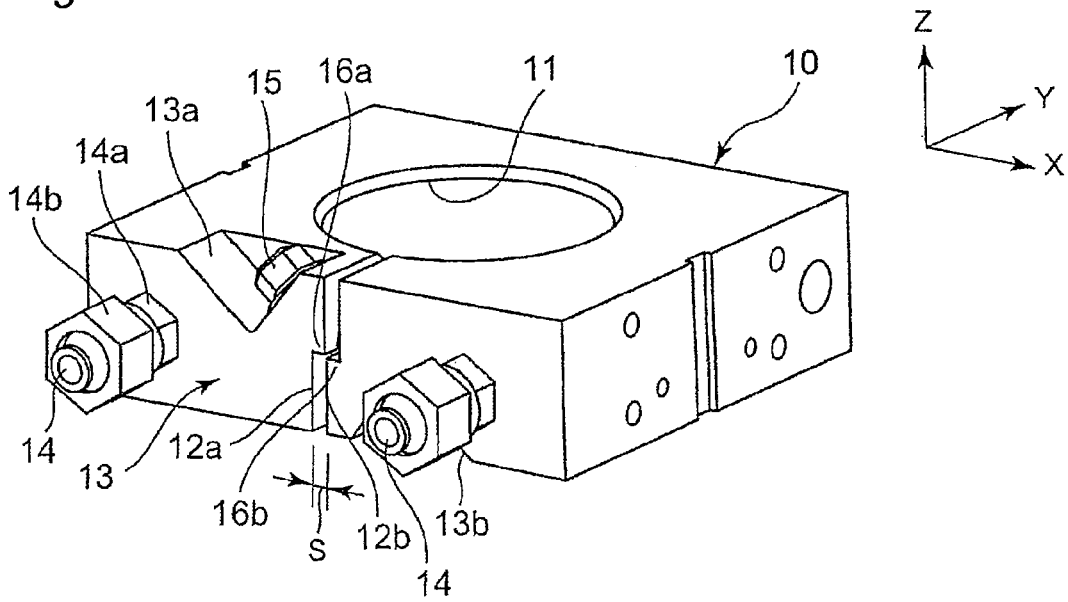
FIG. 3 is a perspective view of a cooling block of the magnetron according to the first embodiment.
Figure 4:
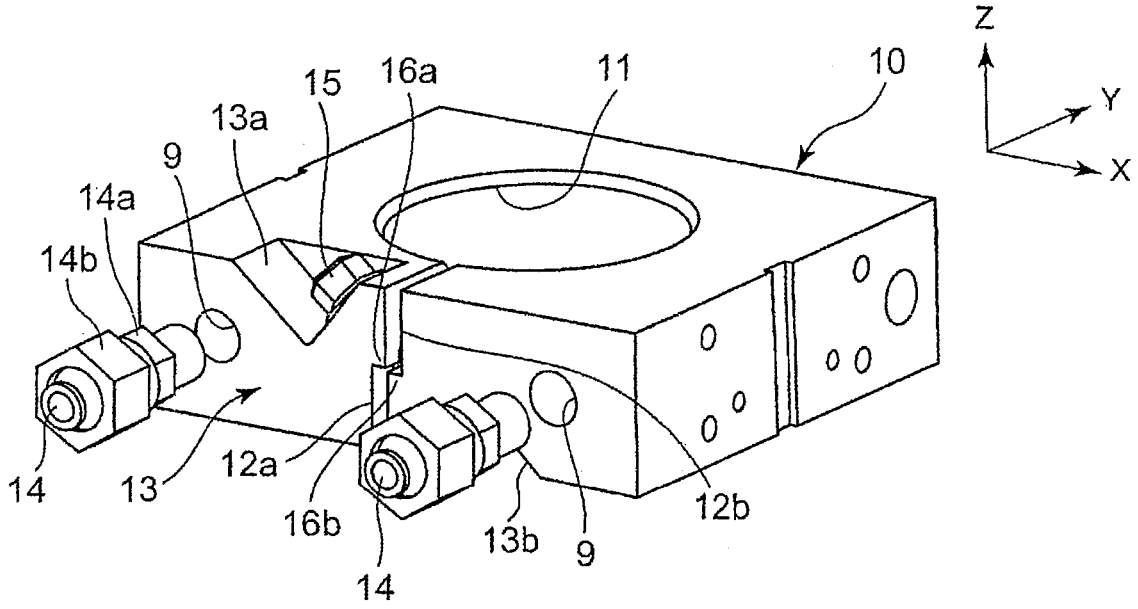
FIG. 4 is a partially exploded perspective view of the cooling block of FIG. 3 with pipe joints removed.

A structure of the cooling block 10 of the magnetron according to the first embodiment is explained hereinafter. FIG. 3 is a perspective view of the cooling block 10 and FIG. 4 is a perspective view (a partially exploded view) of the cooling block 10 with pipe joints for connecting cooling liquid pipes removed.

The cooling block 10 is held in direct or indirect contact with the cylindrical anode body 5 and the annular permanent magnets 6A, 6B to cool them. More specifically, as shown in FIG. 3 and FIG. 4, the cooling block 10 has an outer shape in the form of a generally rectangular parallelepiped and is formed into an integrated member made of, for example, a metallic material having a high thermal conductivity. The cooling block 10 has a coolant circulation pathway 9 defined therein.

The cooling block 10 has an annular continuous portion encircling an outer peripheral surface of the cylindrical anode body 5. The annular continuous portion has opposite end portions positioned adjacent to and opposed to each other to form an annular shape. That is, the cooling block 10 is generally in the form of a C as viewed from above in FIG. 3 (as viewed in the Z direction) and has an annular discontinuous portion only at a portion thereof. An inner peripheral surface 11 of the cooling block 10 is formed as an inner peripheral surface that can be brought into close contact with the outer peripheral surface of the cylindrical anode body 5. On the other hand, an outer periphery of the cooling block 10 is formed into a generally square shape so as to be accommodated within the casing 8 of the magnetic yoke 2. Also, the cooling block 10 is held in indirect contact at an upper surface thereof in proximity to the inner peripheral surface 11 with the annular permanent magnet 6A via a separate member and is similarly held in indirect contact at a lower surface thereof in proximity to the inner peripheral surface 11 with the annular permanent magnet 6B via another separate member. In the following discussion, the opposite end portions of the annular continuous portion of the cooling block 10 are referred to as "opposing end portions 12*a*, 12*b*."

A pair of pipe joints 14 for supplying and discharging a coolant are connected to a side surface 13 of the cooling block 10 (hereinafter referred to as an "access side surface 13") on the outer periphery of the generally square shape of the cooling block 10, on the side of which side surface the opposing end portions 12*a*, 12*b* are disposed, so as to communicated with the coolant circulation pathway 9. The pair of pipe joints 14 are respectively disposed adjacent to the opposing end portions 12*a*, 12*b*, which are positioned between the pair of pipe joints 14.

Each pipe joint 14 includes a fixing bolt 14*a* for fixing the pipe joint 14 itself to the cooling block 10 and a connecting nut 14*b* for releasably connecting a coolant supply or discharge pipe to the pipe joint 14. The coolant supply or discharge pipe can be connected or disconnected to or from the pipe joint 14 by rotating the connecting nut 14*b*. The coolant circulation pathway 9 is formed in the cooling block 10 so as to run around the outer periphery of the cylindrical anode body 5 from a connecting portion of one of the pipe joints 14 before reaching a connecting portion of the other of the pipe joints 14.

The opposing end portions 12*a*, 12*b* are disposed at a central portion of the access side surface 13 and a gap S is formed between the opposing end portions 12*a*, 12*b*. This gap S between the opposing end portions 12*a*, 12*b* forms the annular discontinuous portion. A tightening member (for example, a tightening bolt and a nut) 15 engages with respective opposing end portions 12*a*, 12*b* so that the gap S (distance) between the opposing end portions 12*a*, 12*b* can be reduced by tightening (screw-tightening) the tightening member 15. In this way, the inner peripheral surface 11 of the cooling block 10 is pressed against and held in close contact with the outer peripheral surface of the cylindrical anode body 5 by reducing the gap S between the opposing end portions 12*a*, 12*b* to thereby rigidly secure the cooling block 10 to the cylindrical anode body 5. In this first embodiment, the gap S is set to, for example, about 3 mm before tightening.

As shown in FIG. 3 and FIG. 4, the tightening member 15 extends in a direction oblique to a plane (an XY plane) including an annular direction of the cooling block 10 (a direction circling around the cylindrical anode body 5). That is, the tightening member 15 is disposed so as to have an axial direction extending in a direction oblique to an upper surface of the cooling block 10. Also, two recesses 13*a*, 13*b* are formed in the access side surface 13 in proximity to the opposing end portions 12*a*, 12*b* so as to respectively open on the upper surface side and the lower surface side and to be directed to the center side. The opposing end portions 12*a*, 12*b* have respective insertion holes 13*c*, 13*d* defined therein, into which the tightening member 15 is inserted through the recesses 13*a*, 13*b*. When the tightening member 15 has been inserted into the insertion holes 13*c*, 13*d*, opposite end portions of the tightening member 15 are respectively accommodated within the recesses 13*a*, 13*b*.

In the cooling block 10 according to the first embodiment, the direction in which the tightening member 15 extends (axial direction) is inclined with respect to the XY plane. Accordingly, when the tightening member 15 is tightened, a force component in the Z direction is created on the opposing end portions 12*a*, 12*b* in addition to that in the X direction. In such a situation, the opposing end portions 12*a*, 12*b* move in different directions in the Z direction, thus resulting in twisting of the cooling block 10. In order to reduce the generation of such twisting, the cooling block 10 according to the first embodiment is provided with a regulatory structure for regulating the movement of the opposing end portions 12*a*, 12*b* in the Z direction.

Figure 6:
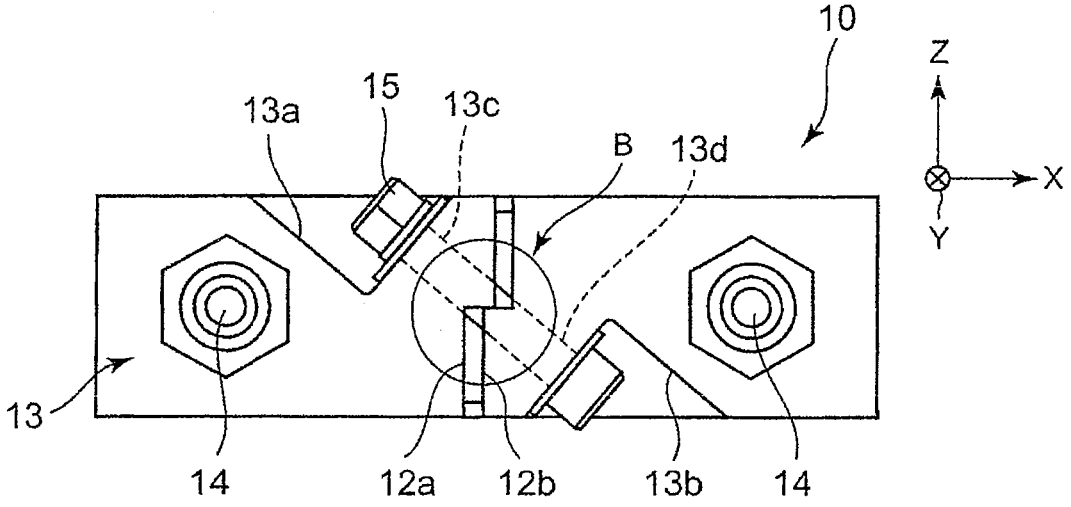
FIG. 6 is a front view of the cooling block of FIG. 3 as viewed from the access side surface (after tightening).
Figure 7:
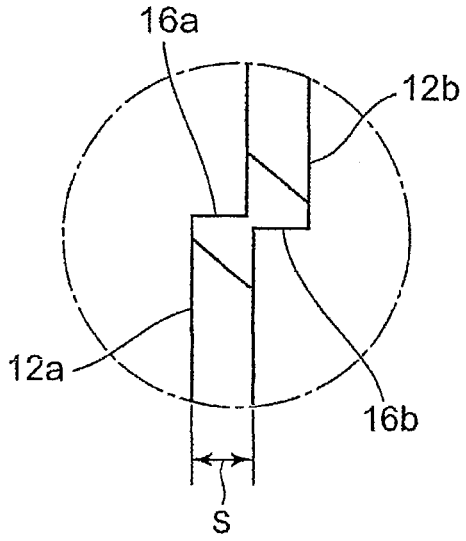
FIG. 7 is an enlarged view of portion A of opposing end portions of the cooling block of FIG. 5.
Figure 8:
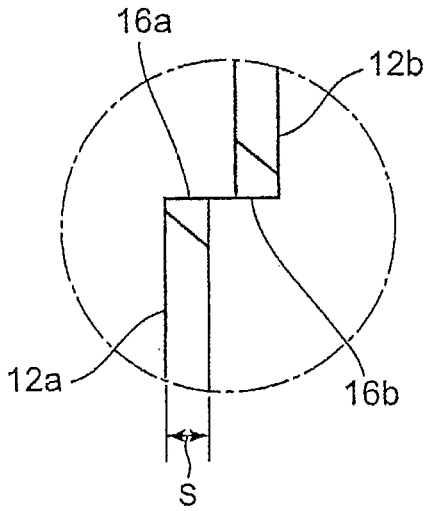
FIG. 8 is an enlarged view of portion B of the opposing end portions of the cooling block of FIG. 6.
Figure 9:
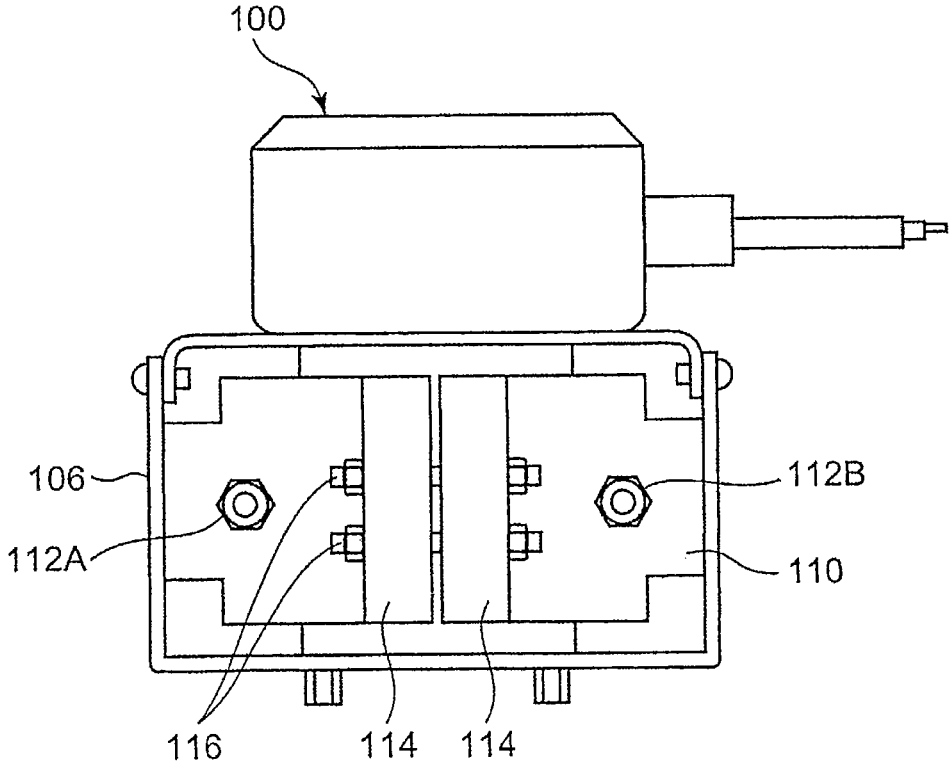
Fig. 9 PRIOR ART
FIG. 9 is a view showing a general structure of a conventional magnetron.

This regulatory structure is explained hereinafter with reference to FIG. 5 and FIG. 6 each showing a front view of the access side surface 13 of the cooling block 10. Also, FIG. 7 shows, on an enlarged scale, portion A of the opposing end portions 12*a*, 12*b* shown in FIG. 5 and FIG. 8 shows, on an enlarged scale, portion B shown in FIG. 6.

Figure 5:
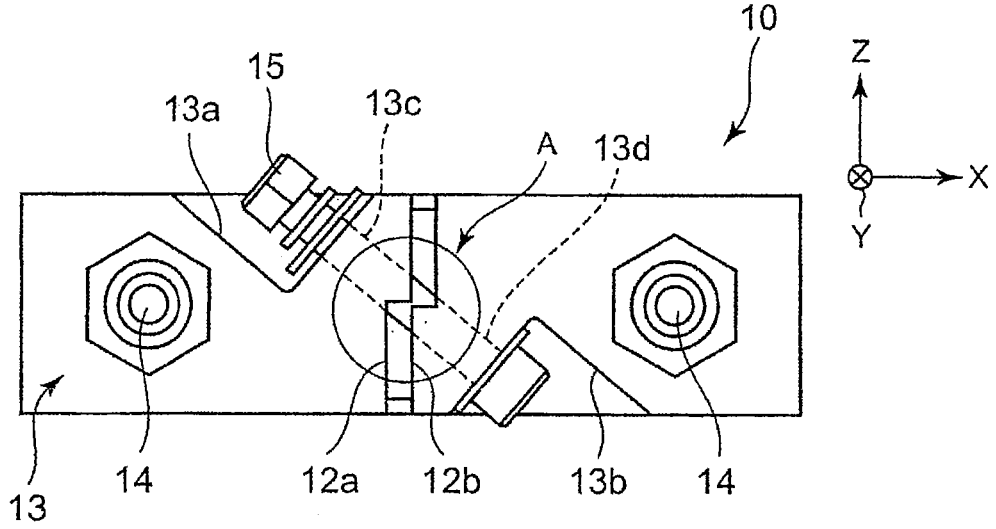
FIG. 5 is a front view of the cooling block of FIG. 3 as viewed from an access side surface (before tightening).

As shown in FIG. 5, the opposing end portions 12*a*, 12*b* are respectively formed with stepped portions 16*a*, 16*b* that are engageable with each other. The opposing end portion 12*a* on the left side of the figure is provided with the stepped portion 16*a* having an upper side end surface in the Z direction that protrudes beyond a lower side end surface, and the opposing end portion 12*b* on the right side of the figure is provided with the stepped portion 16*b* having a lower side end surface that protrudes beyond an upper side end surface (see FIG. 7)

When the tightening member 15 is tightened from a state shown in FIG. 5, the gap S between the opposing end portions 12*a*, 12*b* is reduced to thereby cause the opposing end portions 12*a*, 12*b* to approach each other in the X direction. At the same time, the opposing end portions 12*a*, 12*b* try to also move in the Z direction. However, the stepped portions 16*a*, 16*b* of the opposing end portions 12*a*, 12*b* are brought into contact with each other to thereby regulate the movement of the opposing end portions 12*a*, 12*b* in the Z direction (see FIG. 8). When the tightening member 15 is further tightened from this state, the gap S between the opposing end portions 12*a*, 12*b* is further reduced with the movement of the opposing end portions 12*a*, 12*b* in the Z direction regulated by the contact of the stepped portions 16*a*, 16*b*. The employment of such a regulatory structure can curb the twisting of the cooling block 10 that may be caused by the tightening while employing an arrangement in which the tightening member 15 extends in the direction oblique to the XY plane.

When it comes to forces applied to the opposing end portions 12*a*, 12*b* by tightening the tightening member 15, it is desirable that a force component in the X direction be greater than that in the Z direction. For this reason, it is desirable that the angle of inclination of the tightening member 15 with respect to the XY plane be less than 45 degrees. In this first embodiment, the angle of inclination of the tightening member 15 is set to, for example, 40 degrees.

In the magnetron of the above-described construction according to the first embodiment, the tightening member 15 extends in the direction oblique to the upper surface of the cooling block 10 (that is, the XY plane) and, hence, while employing an arrangement in which the tightening member 15 is disposed between the connecting portions of a pair of pipe joints 14, access to the tightening member 15 is less likely to be affected by the presence of the pipe joints 14. Similarly, access to the pipe joints 14 is less likely to be affected by the presence of the tightening member 15. Because of this, even if the pair of pipe joints 14 are connected to the cooling block 10 and coolant pipes are also respectively connected to the pipe joints 14, a work for tightening the tightening member 15 or the like can be conducted by accessing the tightening member 15. Also, in a state where the tightening member 15 has engaged with the cooling block 10, the fixing bolts 14*a* or the connecting nuts 14*b* can be manipulated or rotated by accessing the pipe joints 14. As just described, in the cooling block 10 according to the first embodiment, access to the pipe joints 14 and the tightening member 15 can be improved.

In this way, in accessing one of the tightening member 15 and the pipe joints 14, the others can be prevented from interfering therewith, thus making it possible to enhance the degree of freedom in arranging a side surface (connecting surface) of the cooling block 10 to which the pipe joints 14 are connected.

Figure 10:
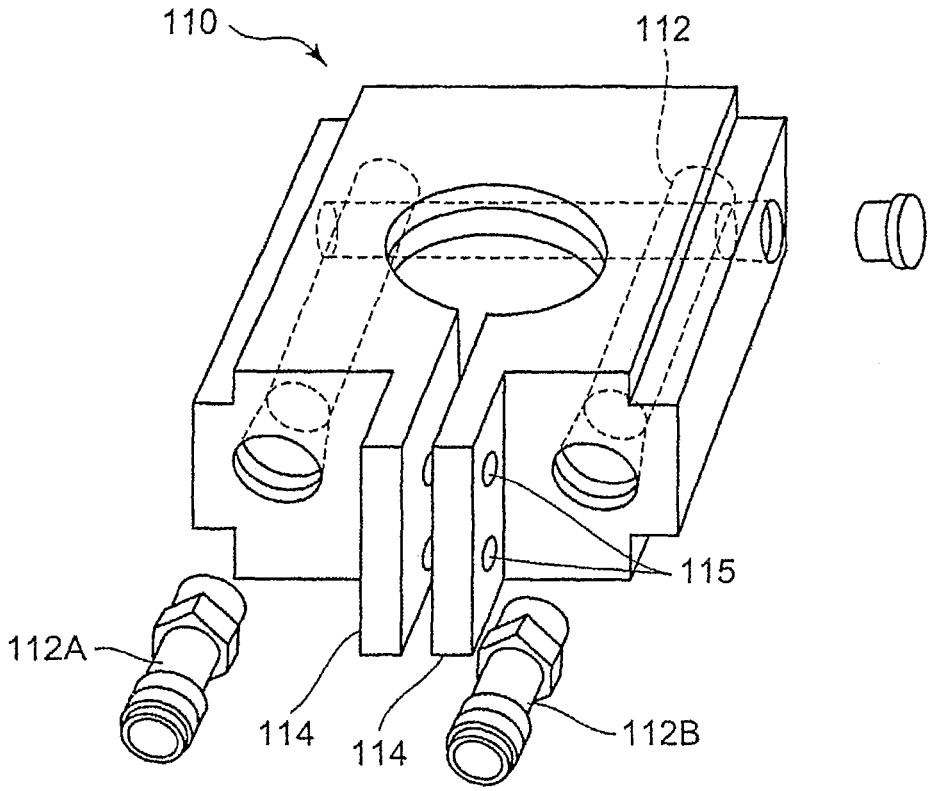
Fig. 10 PRIOR ART
FIG. 10 is a view showing a structure of a cooling block of the conventional magnetron.

If the tightening member extends in the X direction, an arrangement in which the connecting surface of the pipe joints is shifted inwardly toward the center side of the cooling block must be employed (for example, an arrangement as shown in FIG. 10) in consideration of access to the tightening member and interference between the tightening member and the pipe joints. However, because the arrangement according to the first embodiment needs not take into consideration mutual access interference between the pipe joints 14 and the tightening member 15, the connecting surface of the cooling block 10 with the pipe joints 14 can be positioned at a location overlapping, in the Y direction, with a location where the insertion holes 13*c*, 13*d* of the tightening member 15 have been formed or at another location outwardly of such a location of formation of the insertion holes 13*c*, 13*d*. For this reason, in applications where the cooling block 10 is formed, for example, by cutting a member generally in the form of a rectangular parallelepiped, an arrangement of the pipe joints 14 and the tightening member 15 capable of reducing a material to be removed can be realized compared with the conventional cooling block as shown in FIG. 10. Accordingly, not only can a material loss be reduced in producing the cooling block, but access to the pipe joints 14 and the tightening member 15 can be also improved. Also, it is sufficient if a lesser amount of material is cut to thereby increase the volume of the cooling block 10, thus making it possible to enhance the cooling performance.

Further, the regulatory structure for regulating the movement of the opposing end portions 12*a*, 12*b* in the Z direction while permitting the movement of the opposing end portions 12*a*, 12*b* in the X direction is employed. Because of this, while employing the arrangement in which the tightening member 15 extends in an inclined direction, twisting of the cooling block 10, which may be caused by tightening the tightening member 15, can be curbed.

Also, the opposite end portions of the tightening member 15 are accommodated within respective recesses 13*a*, 13*b* formed in the access side surface 13, thereby making it possible to more positively avoid interference between the tightening member 15 and the pipe joints 14. In addition, it is sufficient if the recesses 13*a*, 13*b* have a size capable of accommodating the opposite end portions of the tightening member 15, thus making it possible to reduce a material to be cut away for formation of the access side surface 13 and reduce a loss of production.

In the first embodiment referred to above, although the cooling block 10 has been described as having the connecting surface of the pipe joints 14 and the portion of formation of the opposing end portions 12*a*, 12*b* both lying on the same plane (XZ plane) on the side of the access side surface 13, the present disclosure is not limited to only such a case. In place of this case, the connecting surface of the pipe joints 14 may be shifted, for example, inwardly in the Y direction from the portion of formation of the opposing end portions 12*a*, 12*b* on the side of the access side surface 13 to reduce those portions of the pipe joints 14 that protrude from the casing 8 of the magnetic yoke 2. From the point of view of reducing an amount of material to be cut away in producing the cooling block 10, it is preferred that the connecting surface of the pipe joints 14 be positioned at a location overlapping with or outwardly of the location of formation of the insertion holes 13*c*, 13*d*.

Although in the above-described first embodiment the stepped portions are employed as the regulatory structure for regulating the movement of the opposing end portions 12*a*, 12*b* in the Z direction, various other structures can be employed. If there exist planes having respective components extending in the X direction at the portion of engagement of the opposing end portions 12*a*, 12*b*, such planes function as a regulatory structure for regulating the movement in the Z direction through each other's engagement.

Also, although in the above-described first embodiment the cooling block 10 has been described as having an outer peripheral surface generally in the form of a square, the cooling block 10 may have a polygonal outer peripheral surface.

Further, it is sufficient if at least one pair of pipe joints 14 are connected to the access side surface 13 and, accordingly, plural pairs of pipe joints may be connected.

Also, a plurality of tightening members 15 extending in the same inclined direction may be used.

Any combination of the various embodiments referred to above can produce respective effects.

What is claimed is:

1. A magnetron comprising:

a cylindrical anode body;

a cooling block formed into an integrated member having an annular continuous portion with opposite end portions opposed to each other, the cooling block being secured to an outer peripheral surface of the cylindrical anode body so as to encircle the cylindrical anode body, the cooling block having a coolant circulation pathway defined therein to cool the cylindrical anode body;

a tightening member engageable with the opposite end portions of the cooling block to tighten the cooling block by reducing a distance between the opposite end portions of the cooling block to thereby press an inner peripheral surface of the cooling block against the outer peripheral surface of the cylindrical anode body; and a pair of pipe joints each connected to a portion of the cooling block adjacent to one of the opposite end portions so as to communicate with the coolant circulation pathway, wherein the tightening member is disposed between connecting portions of the pair of pipe joints with the cooling block so as to extend in a direction inclined with respect to a plane including an annular direction of the cooling block.

2. The magnetron according to claim 1, wherein the opposite end portions of the annular continuous portion of the cooling block have respective insertion holes defined therein into which the tightening member is inserted, a connecting surface of the cooling block with the pair of pipe joints being positioned at a location overlapping with or outwardly of a location of formation of the insertion holes.

3. The magnetron according to claim 1, wherein the cooling block has a regulatory structure configured to regulate a movement of the opposite end portions of the cooling block in a direction perpendicular to the plane including the annular direction of the cooling block when the opposite end portions of the cooling block are engaged with each other in tightening the cooling block by the tightening member.

4. The magnetron according to claim 1, wherein an angle of inclination of the tightening member is less than 45 degrees with respect to the plane including the annular direction of the cooling block.

5. The magnetron according to claim 1, wherein the cooling block has two recesses defined in a connecting surface thereof with the pair of pipe joints and opposite end portions of the tightening member are respectively accommodated within the two recesses.

6. The magnetron according to claim 1, wherein the cooling block has a generally square outer periphery, on one end of which the pair of pipe joints and the tightening member are disposed.

* * * * *